United States Patent [19]

Arakawa et al.

[11] Patent Number: 4,855,191

[45] Date of Patent: Aug. 8, 1989

[54] RADIATION IMAGE CONVERTING MATERIAL

[75] Inventors: Satoshi Arakawa, Minami-ashigara; Akira Kitada, Odawara; Kikuo Yamazaki, Minami-ashigara; Kenji Ohmiya, Odawara; Jun Kawagoe, Fujinomiya, all of Japan

[73] Assignee: Fuji Photo Film Co., Ltd., Kanagawa, Japan

[21] Appl. No.: 110,367

[22] Filed: Oct. 20, 1987

[30] Foreign Application Priority Data

Oct. 20, 1986 [JP] Japan ..... 61-248852
Feb. 27, 1987 [JP] Japan ..... 62-46475

[51] Int. Cl.[4] ..... G03C 5/17; G21K 0/4

[52] U.S. Cl. ..... 428/690; 428/917; 250/483.1

[58] Field of Search ..... 428/690, 691, 917; 250/483.1–488.1

[56] References Cited

U.S. PATENT DOCUMENTS

| | | | |
|---|---|---|---|
| 3,375,131 | 3/1968 | Schmidt | 428/917 X |
| 3,580,738 | 5/1971 | Ranby | 428/917 X |
| 4,689,278 | 8/1987 | Umemoto et al. | 428/917 X |
| 4,758,464 | 7/1988 | Masuzawa et al. | 428/917 X |

FOREIGN PATENT DOCUMENTS

| | | | |
|---|---|---|---|
| 0107207 | 5/1984 | Japan | 428/917 |

*Primary Examiner*—Nancy A. B. Swisher
*Attorney, Agent, or Firm*—Gerald J. Ferguson, Jr.

[57] ABSTRACT

Radiation image converting materials such as a radiation image storage panel and a radiographic intensifying screen comprising a support and a phosphor layer provided on the support which comprises a binder and a phosphor dispersed therein are provided with an electrically conductive polymer layer.

8 Claims, 5 Drawing Sheets

FIG. 1-(1)
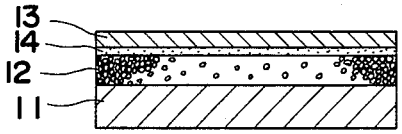
FIG. 1-(2)
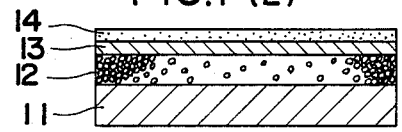
FIG. 1-(3)
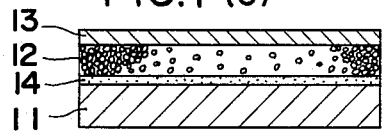
FIG. 1-(4)
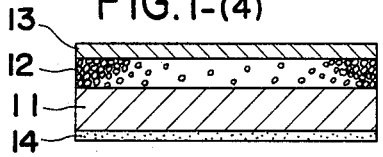
FIG. 1-(5)
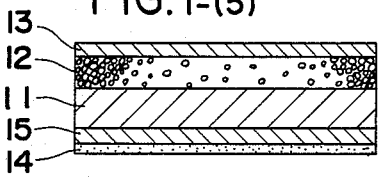

FIG.4-(1)
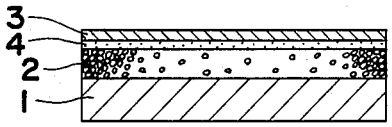
FIG.4-(2)
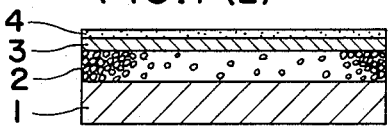
FIG.4-(3)
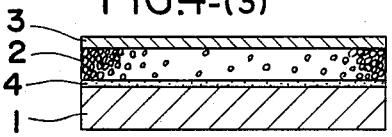

FIG. 5
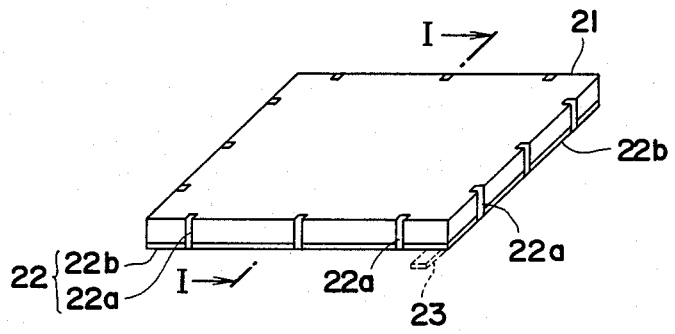
FIG. 5-A
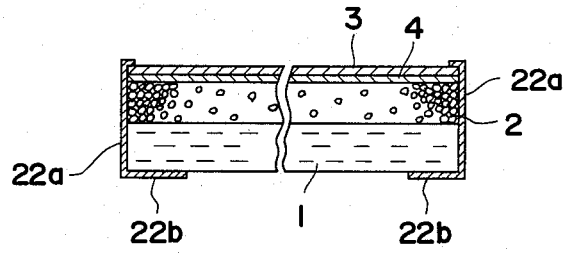

RADIATION IMAGE CONVERTING MATERIAL

BACKGROUND OF THE INVENTION

1. Field of the Invention

The present invention relates to a radiation image converting material provided with a conductive polymer layer which is improved in the antistatic property. More particularly, the invention relates to a radiographic intensifying screen, and a radiation image storage panel employed in a radiation image recording and reproducing method utilizing a stimulable phosphor.

2. Description of the Prior Art

In a variety of radiography such as medical radiography for diagnosis and industrial radiography for non-destructive inspection, a radiographic intensifying screen is generally employed in close contact with one or both surfaces of a radiographic film such as an X-ray film for enhancing the radiographic speed of the system.

As a method replacing the radiography, a radiation image recording and reproducing method utilizing a stimulable phosphor as described, for instance, in U.S. Pat. No. 4,239,968, has been recently paid much attention. In this method, a radiation image storage panel comprising a stimulable phosphor (i.e., stimulable phosphor sheet) is employed, and the method involves the steps of causing the stimulable phosphor of the panel to absorb radiation energy having passed through an object or having radiated from an object; sequentially exciting the stimulable phosphor with an electromagnetic wave such as visible light or infrared rays (hereinafter referred to as "stimulating rays") to release the radiation energy stored in the phosphor as light emission (stimulated emission); photoelectrically detecting the emitted light to obtain electric signals; and reproducing the radiation image of the object as a visible image from the electric signals.

In the radiation image recording and reproducing method, a radiation image is obtainable with a sufficient amount of information by applying a radiation to an object at considerably smaller dose, as compared with the conventional radiography. Accordingly, this method is of great value especially when the method is used for medical diagnosis.

The radiation image converting materials such as the radiographic intensifying screen employed in the conventional radiography and the radiation image storage panel employed in the above-described radiation image recording and reproducing method comprise a support and a phosphor layer provided thereon. Further, a transparent film is generally provided on the free surface of the phosphor layer (a surface not facing the support) to keep the phosphor layer from chemical deterioration and physical shock.

In the radiation image storage panel, the phosphor layer comprises a binder and stimulable phosphor particles dispersed therein. The stimulable phosphor emits light (gives stimulated emission) when excited with an electromagnetic wave (stimulating rays) such as visible light or infrared rays after having been exposed to a radiation such as X-rays. Accordingly, the radiation having passed through an object or radiated from an object is absorbed by the phosphor layer of the panel in proportion to the applied radiation dose, and a radiation image of the object is produced in the panel in the form of a radiation energy-stored image. The radiation energy-stored image can be released as stimulated emission by sequentially irradiating (scanning) the panel with stimulating rays. The stimulated emission is then photoelectrically detected to give electric signals, so as to reproduce a visible image from the electric signals.

The radiation image recording and reproducing method is very advantageous for obtaining a visible image as described above, and the radiation image storage panel used in the method is desired to have high sensitivity and provide an image of high quality (high sharpness, high graininess, etc.), as well as a radiographic intensifying screen used in the conventional radiography. In performing the radiation image recording and reproducing method, the radiation image storage panel is repeatedly used in a cyclic procedure comprising the steps of: exposing the panel to a radiation (recording radiation image thereon), irradiating the panel with stimulating rays (reading out the recorded radiation image therefrom) and irradiating the panel with a light for erasure (erasing the remaining radiation image therefrom). The panel is transferred from a step to the subsequent step in a transfer system in such a manner that the panel is sandwiched between transferring members (e.g., rolls and endless belt) of the system, and piled on other panels to be stored after one cycle is finished.

As a support material of the radiation image storage panel, desirably employed are plastic films such as a polyethylene terephthalate film and various papers from the viewpoint of flexibility required in the transferring procedure of the panel.

However, the panel is apt to be electrostatically charged on its surface in the repeated use comprising transferring and piling owing to the physical contact such as friction between the surface of the panel (surface of the phosphor layer or surface of the protective film) and a surface of other panel (surface of the support), friction between the edge of the panel and a surface of other panel, and a friction between the panel and transferring members (e.g., roll and belt). In more detail, the surface (front surface) of the panel made of a polymer material tends to be negatively charged and other surface (back surface) thereof tends to be positively charged. This static electrification causes various problems in the practical operation of the radiation image recording and reproducing method.

For example, when the surface of the panel is charged, the panel easily adheres to another panel and panes under adhesion panels are transferred together in layers from the piling position into the transfer system, whereby the subsequent procedure cannot be normally conducted. The read-out procedure of the panel is generally carried out by irradiating the panel with stimulating rays from the phosphor layer-side surface of the panel, and in this procedure, the charged surface of the panel is likely to be attached with dust in air, so that the stimulating rays are also scattered on the dust attached thereon and the quality of the resulting image lowers. Moreover, the resulting image provided by the panel suffers noise (static mark) when discharge of the panel takes place.

For improving the above-mentioned static electrification of the panel, there have been proposed various radiation image storage panels provided with antistatic functions, for example, a radiation image storage panel provided with an antistatic film comprising a conductive inorganic oxide on the surface of the protective film as described in U.S. patent application Ser. No. 818,239 (corresponding to EP Application No. 86100417.4) and a radiation image storage panel provided with an antistatic layer made of a conductive material and having a specific surface resistivity ($10^{11}$ ohm) on the surface of the support not facing the phosphor layer or between the support and the phosphor layer as described in U.S. patent application Ser. No. 918,356 (corresponding to EP Application No. 86114224.8).

In the radiographic intensifying screen, the phosphor layer comprises a binder and phosphor particles dispersed. therein. When excited with a radiation such as X-rays having passed through an object, the phosphor particles emit light of high luminance (spontaneous emission) in proportion to the dose of the radiation. Accordingly, the radiographic film placed in close contact with the phosphor layer of the screen can be exposed sufficiently to form a radiation image of the object, even if the radiation is applied to the object at a relatively small dose.

The conventional radiography is generally conducted by encasing the radiographic intensifying screen and a radiographic film in a light-blocking cassette in such a manner that the screen and the film are arranged in close contact with each other. However, since both of the screen and the film are made of plastic material, the screen and the film are electrostatically charged due to contact with each other when the film is received in or is taken out of the cassette. As a result, discharge occasionally takes place, and an image formed on the film likely suffers noise (static mark), whereby accuracy of diagnostic examination lowers.

Recently, a continous radiographic system using no cassette (i.e., cassetteless system) has been developed and utilized for enhancing the examination efficiency. For example, in a radiographic apparatus for angiocardiography, a pair of radiographic intensifying screens fixed at the predetermined position, and in the radiographic operation, a number of radiographic films having been received in a magazine equipped in the apparatus are automatically and continuously transferred one after another to be received between the two screens. The used film is then transferred and received in a different magazine for used films by a transferring device, and at the same time an unused film is set between the screens. Thus, the radiographic procedures are continuously carried out at a high speed.

In the above-mentioned cassetteless system, the radiographic film is liable to be much more electostatically charged than the case of using the cassette, because contact of a film with another film and the contact of the film with the transferring members in the transferring procedure take place repeatedly, in addition to the contact of the film with the screen. As a result, a discharge phenomenon between the film and the screen takes place.

For preventing the occurrence of the static electrification and discharge, various technological measures have been proposed and practically utilized for the radiographic screen. For example, a method of coating or spraying a liquid antistatic agent onto the screen is generally utilized, but this method forms merely a coated layer on the surface of the screen. Hence, the coated layer tends to gradually separate from the screen as a lapse of time, owing to the contact with the radiographic film, etc., and the screen is reduced in the antistatic properties. Especially in the high speed radiography, there is such a trouble that the antistatic treatment (coating of the antistatic agent) should be repeatedly made at an appropriate interval because a great number of radiographic operations should be repeatedly performed.

For providing the antistatic properties to the radiographic intensifying screen, it is described that a carbon black layer is provided between the support and the phosphor layer and an antistatic agent is incorporated into its protective film in Japanese Patent Provisional Publication No. 52(1977)-28284. It is stated that according to this method the resulting radiographic intensifying screen can be prevented from electrostatical charging owing to the functions of the carbon black layer and the protective film.

SUMMARY OF THE INVENTION

It is an object of the present invention to provide a radiation image storage panel which is improved in the antistatic properties.

It is another object of the invention to provide a radiation image storage panel which is reduced in the occurrence of static mark to give an improved image.

It is a further object of the invention to provide a radiographic intensifying screen which is improved in the antistatic properties.

It is a still further object of the invention to provide a radiographic intensifying screen which is reduced in the occurrence of static mark to give an improved image.

The above-mentioned objects can be accomplished by radiation image converting material such as a radiation image storage panel and a radiographic intensifying screen comprising a support and a phosphor layer provided on the support which comprises a binder and a phosphor dispersed therein, characterized in that said radiation image converting material is provided with a conductive polymer layer.

The expression "a conductive polymer constituting a conductive polymer layer" used herein means a polymer per se showing an electric conductivity.

In the radiation image storage panel, a conductive polymer layer is provided on at least one of layers constituting the panel, whereby the panel is improved in the antistatic properties on the surface (phosphor layer-side surface) of the panel.

According to the invention, the static electrification occurring on the surface of the radiation image storage panel can be effectively prevented. In more detail, the provision of a conductive polymer layer enables to keep the surface of the resulting panel under electrostatically stable condition (i.e., reduced charge condition). The reason is presumed as follows: when the surface of the panel is charged with a large quantity of electricity, an opposite charge of the same quantity of electricity is produced in the conductive polymer layer of the panel, if the conductive polymer layer is provided between the layers (e.g., between the support and the phosphor layer) of the panel or the surface of the panel, and hence the surface of the panel is apparently less charged. Particularly in the use of providing the conductive polymer layer on the surface of the panel or in the vicinity thereof (e.g., surface of the phosphor layer, or between the phosphor layer and a protective film in the case that the protective film is provided on the phosphor layer), a high antistatic effect can be attained. Accordingly, the phosphor layer-side surface of the panel is reduced in the attraction force for other material which is caused by the static charge. As a result, it is prevented that two panels are introduced into the transfer system in the combined form from the piling state to the transferring state in the radiation image recording and reproducing apparatus. Further, the panel is effectively kept from deposit of dust on the phosphor layer-side surface, and the occurrence of noise (static mark) is also prevented on a image provided by the panel, whereby an image of high quality is obtained.

The polymer which constitutes the conductive polymer layer of the panel according to the invention is transparent, so that even when the conductive polymer layer is provided on the upper side than that of the phosphor layer (in the vicinity of the surface of the panel), the stimulating rays having been irradiated on the panel are hardly blocked by the polymer layer and the stimulating rays are sufficiently transmitted through the layer. Hence, the panel provides an image of high quality without being lowered in the sensitivity.

In the radiographic intensifying screen, the conductive polymer layer can be also arranged at any position, as well as in the case of the above-described radiation image storage panel. By providing the conductive polymer layer, the surface of the radiographic intensifying screen (opposite side surface of the support) can be improved in the antistatic properties. The conductive polymer layer arranged on the surface of the phosphor layer or the surface of the support (or between the phosphor layer and the support) can keep the surface of the screen in the electrostatically stable condition (i.e., reduced charge condition). The reason is presumed as follows: when the surface of the screen is charged with a large quantity of electricity, an opposite charge of the same quantity of electricity is produced in the conductive polymer layer of the surface of the screen, and hence the surface of the screen is apparently less charged. Particularly in the case of providing the conductive polymer layer in the vicinity of the surface of the screen (e.g., surface of the phosphor layer or between the phosphor layer and a protective film in the case that the protective film is provided on the phosphor layer), a high antistatic effect is given. Accordingly, a radiographic film used in close contact with the radiographic intensifying screen is hardly given an unfavorable effect caused by the static charge, and hence an improve image which is almost free from occurrence of noise such as static mark is obtained.

BRIEF DESCRIPTION OF THE DRAWINGS

FIG. 1 is sectional views illustrating various constitutions of the radiation image storage panels according to the invention.

FIG. 4 is sectional views illustrating favorable constitutions of the radiographic intensifying screen according to the invention.

FIG. 5 is a perspective view illustrating another constitution of the radiographic intensifying screen according to the invention, and FIG. 5-(A) is a sectional view taken along the line I—I of FIG. 5.

DETAILED DESCRIPTION OF THE INVENTION

Figure 2:
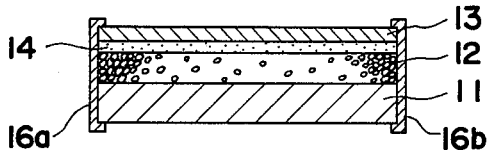
FIG. 2 is a sectional view illustrating an embodiment of the radiation image storage panel provided with a covering according to the invention.

Representative examples of the radiation image converting material of the present invention are a radiation image storage panel and a radiographic intensifying screen.

First, the radiation image converting material of the invention is described in detail with respect to the radiation image storage panel.

The radiation image storage panel of the invention basically comprises a support and a phosphor layer provided on the support which comprises a binder and a stimulable phosphor dispersed therein, and the panel is further provided with a conductive polymer layer.

Thus, the radiation image storage panel has at least one conductive polymer layer (described hereinafter) arranged in any desired position.

FIG. 1 shows favorable embodiments of the radiation image storage panel according to the invention.

In each of FIGS. 1-(1) to 1-(4), the panel comprises a support (11), a phosphor layer (12), a protective film (13) and a conductive polymer layer (14). The conductive polymer layer (14) is arranged between the phosphor layer and the protective film in FIG. 1-(1), on the surface of the protective film (panel surface) in FIG. 1-(2), between the phosphor layer and the support in FIG. 1-(3), or on the surface of the support (surface not facing the phosphor layer) in FIG. 1-(4). In FIG. 1-(5), the panel further comprises a back layer (15) provided on the surface of the support in addition to the above-mentioned layers, and the conductive polymer layer (14) is provided on the surface of the back layer. The structure of the radiation image storage panel according to the invention is by no means restricted to the above-mentioned ones, and any other constituents can be utilized in the invention. For example, an additional layer such as an intermediate layer can be optionally provided in the panel of the above structure.

The radiation image storage panel according to the invention is described in detail hereinafter referring to the embodiment shown in FIG. 1-(1).

The radiation image storage panel can be prepared, for example, by the following process.

Examples of the support material employable in the radiation image storage panel of the invention include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image recording material and handling thereof, a plastic film is preferably employed as the support material in the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, one or more additional layers are occasionally provided between the support and the phosphor layer, so as to enhance the adhesion between the support and the phosphor layer, or to improve the sensitivity of the panel or the quality of an image (sharpness and graininess) provided thereby. For instance, a subbing layer may be provided by coating a polymer material such as gelatin over the surface of the support on the phosphor layer side. Otherwise, a light-reflecting layer may be provided by forming a polymer material layer containing a light-reflecting material such as titanium dioxide. In the invention, one or more of these additional layers may be provided on the support.

As described in U.S. patent application No. 496,278, the phosphor layer-side surface of the support (or the surface of a subbing layer or light-reflecting layer in the case that such layers are provided on the phosphor layer) may be provided with protruded and depressed portions for enhancement of the sharpness of the image.

Subsequently, on the support is provided a phosphor layer. The phosphor layer basically comprises a binder and stimulable phosphor particles dispersed therein. The stimulable phosphor, as described hereinbefore, gives stimulated emission when excited with stimulating rays after exposure to a radiation. From the viewpoint of practical use, the stimulable phosphor is desired to emit light in the wavelength region of 300–500 nm when excited with stimulating rays in the wavelength region of 400–900 nm.

Examples of the stimulable phosphor employable in the panel of the invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO.xAl_2O_3$:Eu, in which x is a number satisfying the condition of $0.8 \leqq x \leqq 10$, and $M^{2+}O.xSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,236,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$ and $xy=0$, and a is a number satisfying the condition of $10^{-6} \leqq a \leqq 5\times10^{-2}$, as described in Jpanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in U.S. Pat. No. 4,236,078;

$(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in U.S. Pat. No. 4,239,968;

$M^{II}FX.xA:yLn$, in which $M^{II}$ is at least one element selected from the group consisting of Ba, Ca, Sr, Mg, Zn and Cd; A is at least one compound selected from the group consisting of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$ and $ThO_2$; Ln is at least one element selected from the group consisting of Eu, Tb, Ce, Tm, Dy, Pr, Ho, Nd, Yb, Er, Sm and Gd; X is at least one element selected from the group consisting of Cl, Br and I; and x and y are numbers satisfying the conditions of $5\times10^{-5} \leqq x \leqq 0.5$ and $0<y \leqq 0.2$, respectively, as described in Japanese Patent Provisional Publication No. 55(1980)-160078;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of Zr and Sc; and a, x, y and z are numbers satisfying the conditions of $0.5 \leqq a \leqq 1.25$, $0 \leqq x \leqq 1$, $10^{-6} \leqq y \leqq 2\times10^{-1}$, and $0<z \leqq 10^{-2}$, respectively, as described in Japanese Patent Provisional Publication No. 56(1981)-116777;

$(Ba_{1-x},M^{II}_x)F_2.aBaX_2:yEu,zB$, in which $M^{II}$ is at least one element selected from the group consisting of Be, Mg, Ca, Sr, Zn and Cd; X is at least one element selected from the group consisting of Cl, Br and I; and a, x, y and z are numbers satisfying the conditions of $0.5 \leqq a \leqq 1.25$, $0 \leqq x \leqq 1$, $10^{-6} \leqq y \leqq 2\times10^{-1}$, and $0<z \leqq 2\times10^{-1}$, respectively, as described in Japanese Patent Provisional Publication No. 57(1982)-23673;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of As and Si; and a, x, y and z are numbers satisfying the conditions of $0.5 \leqq a \leqq 1.25$, $0 \leqq x \leqq 1$, $10^{-6} \leqq y \leqq 2\times10^{-1}$, and $0<z \leqq 5\times10^{-1}$, respectively, as described in Japanese Patent Provisional Publication No. 57(1982)-23675;

$M^{III}OX:xCe$, in which $M^{III}$ is at least one trivalent metal selected from the group consisting of Pr, Nd, Pm, Sm, Eu, Tb, Dy, Ho, Er, Tm, Yb, and Bi; X is at least one element selected from the group consisting of Cl and Br; and x is a number satisfying the condition of $0<x<0.1$, as described in Japanese Patent Provisional Publication No. 58(1983)-69281;

$Ba_{1-x}M_{x/2}L_{x/2}FX:yEu^{2+}$, in which M is at least one alkali metal selected from the group consisting of Li, Na, K, Rb and Cs; L is at least one trivalent metal selected from the group consisting of Sc, Y, La, Ce, Pr, Nd, Pm, Sm, Gd, Tb, Dy, Ho, Er, Tm, Yb, Lu, Al, Ga, In and Tl; X is at least one halogen selected from the group consisting of Cl, Br and I; and x and y are numbers satisfying the conditions of $10^{-2} \leqq x \leqq 0.5$ and $0<y \leqq 0.1$, respectively, as described in U.S. patent application No. 497,805;

$BaFX.xA:yEu^{2+}$, in which X is at least one halogen selected from the group consisting of Cl, Br and I; A is at least one fired product of a tetrafluoroboric acid compound; and x and y are numbers satisfying the conditions of $10^{-6} \leqq x \leqq 0.1$ and $0<y \leqq 0.1$, respectively, as described in U.S. patent application No. 520,215;

$BaFX.xA:yEu^{2+}$, in which X is at least one halogen selected from the group consisting of Cl, Br and I; A is at least one fired product of a hexafluoro compound selected from the group consisting of monovalent and divalent metal salts of hexafluoro silicic acid, hexafluoro titanic acid and hexafluoro zirconic acid; and x and y are numbers satisfying the conditions of $10^{-6} \leqq x \leqq 0.1$ and $0 < y \leqq 0.1$, respectively, as described in U.S. patent application No. 502,648;

$BaFX.xNaX':aEu^{2+}$, in which each of X and X' is at least one halogen selected from the group consisting of Cl, Br and I; and x and a are numbers satisfying the conditions of $0 < x \leqq 2$ and $0 < a \leqq 0.2$, respectively, as described in Japanese Patent Provisional Publication No. 59(1984)-56479;

$M^{II}FX.xNaX':yEu^{2+}:zA$, in which $M^{II}$ is at least one alkaline earth metal selected from the group consisting of Ba, Sr and Ca; each of X and X' is at least one halogen selected from the group consisting of Cl, Br and I; A is at least one transition metal selected from the group consisting of V, Cr, Mn, Fe, Co and Ni; and x, y and z are numbers satisfying the conditions of $0 < x \leqq 2$, $0 < y \leqq 0.2$ and $0 < z \leqq 10^{-2}$, respectively, as described in U.S. patent application No. 535,928;

$M^{II}FX.aM^{I}X'.bM'^{II}X''_2.cM^{III}X'''_3.xA:yEu^{2+}$, in which $M^{II}$ is at least one alkaline earth metal selected from the group consisting of Ba, Sr and Ca; $M^{I}$ is at least one alkali metal selected from the group consisting of Li, Na, K, Rb and Cs; $M'^{II}$ is at least one divalent metal selected from the group consisting of Be and Mg; $M^{III}$ is at least one trivalent metal selected from the group consisting of Al, Ga, In and Tl; A is metal oxide; X is at least one halogen selected from the group consisting of Cl, Br and I; each of X', X'' and X''' is at least one halogen selected from the group consisting of F, Cl, Br and I; a, b and c are numbers satisfying the conditions of $0 \leqq a \leqq 2$, $0 \leqq b \leqq 10^{-2}$, $0 \leqq c \leqq 10^{-2}$ and $a+b+c \geqq 10^{-6}$; and x and y are numbers satisfying the conditions of $0 < x \leqq 0.5$ and $0 < y \leqq 0.2$, respectively, as described in U.S. patent application No. 543,326;

$M^{II}X_2.aM^{II}X'_2:xEu^{2+}$, in which $M^{II}$ is at least one alkaline earth metal selected from the group consisting of Ba, Sr and Ca; each of X and X' is at least one halogen selected from the group consisting of Cl, Br and I, and X=X'; and a and x are numbers satisfying the conditions of $0.1 \leqq a \leqq 10.0$ and $0 < x \leqq 0.2$, respectively, as described in U.S. patent application No. 660,987;

$M^{II}FX.aM^{I}X':xEu^{2+}$, in which $M^{II}$ is at least one alkaline earth metal selected from the group consisting of Ba, Sr and Ca; $M^{I}$ is at least one alkali metal selected from the group consisting of Rb and Cs; X is at least one halogen selected from the group consisting of Cl, Br and I; X' is at least one halogen selected from the group consisting of F, Cl, Br and I; and a and x are numbers satisfying the conditions of $0 \leqq a \leqq 4.0$ and $0 < x \leqq 0.2$, respectively, as described in U.S. patent application No. 668,464; and $M^{I}X:Bi$, in which $M^{I}$ is at least one alkali metal selected from the group consisting of Rb and Cs; X is at least one halogen selected from the group consisting of Cl, Br and I; and x is a number satisfying the condition of $0 < x \leqq 0.2$, as described in U.S. patent application No. 846,919.

The $M^{II}X_2.aM^{II}X'_2:xEu^{2+}$ phosphor described in the above-mentioned U.S. patent application No. 660,987 may contain the following additives in the following amount per 1 mol of $M^{II}X_2.aM^{II}X'_2$:

$bM^{I}X''$, in which $M^{I}$ is at least one alkali metal selected from the group consisting of Rb and Cs; X'' is at least one halogen selected from the group consisting of F, Cl, Br and I; and b is a number satisfying the condition of $0 < b \leqq 10.0$, as described in U.S. patent application No. 699,325;

$bKX''.cMgX'''_2.dM^{III}X''''_3$, in which $M^{III}$ is at least one trivalent metal selected from the group consisting of Sc, Y, La, Gd and Lu; each of X'', X''' and X'''' is at least one halogen selected from the group consisting of F, Cl, Br and I; and b, c and d are numbers satisfying the conditions of $0 < b \leqq 2.0$, $0 \leqq c \leqq 2.0$, $0 \leqq d \leqq 2.0$ and $2 \times 10^{-5} \leqq b+c+d$, as described in U.S. patent application No. 723,819;

yB, in which y is a number satisfying the condition of $2 \times 10^{-4} \leqq y \leqq 2 \times 10^{-1}$, as described in U.S. patent application No. 727,974;

bA, in which A is at least one oxide selected from the group consisting of $SiO_2$ and $P_2O_5$; and b is a number satisfying the condition of $10^{-4} \leqq b \leqq 2 \times 10^{-1}$, as described in U.S. patent application No. 727,972;

bSiO, in which b is a number satisfying the condition of $0 < b \leqq 3 \times 10^{-2}$, as described in U.S. patent application No. 797,971;

$bSnX''_2$, in which X'' is at least one halogen selected from the group consisting of F, Cl, Br and I; and b is a number satisfying the condition of $0 < b \leqq 10^{-3}$, as described in U.S. patent application No. 797,971;

$bCsX''.cxSnX'''_2$, in which each of X'' and X''' is at least one halogen selected from the group consisting of F, Cl, Br and I; and b and c are numbers satisfying the conditions of $0 < b \leqq 10.0$ and $10^{-6} \leqq c \leqq 2 \times 10^{-2}$, respectively, as described in U.S. patent application No. 850,715; and $bCsX''.yLn^{3+}$, in which X'' is at least one halogen selected from the group consisting of F, Cl, Br and I; Ln is at least one rare earth element selected from the group consisting of Sc, Y, Ce, Pr, Nd, Sm, Gd, Tb, Dy, Ho, Er, Tm, Yb and Lu; and b and y are numbers satisfying the conditions of $0 < b \leqq 10.0$ and $10^{-6} \leqq y \leqq 1.8 \times 10^{-1}$, respectively, as described in U.S. patent application No. 850,715.

Among these above-described stimulable phosphors, the divalent europium activated alkaline earth metal halide phosphor and rare earth element activated rare earth oxyhalide phosphor are particularly preferred, because these phosphors show stimulated emission of high luminance. The above-described stimulable phosphors are given by no means to restrict the stimulable phosphor empolyable in the panel of the invention. Any other phosphors can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polyalkyl (meth) acrylate, vinyl chloride-vinyl acetate copolymer, polyurethane, cellulose acetate butyrate, polyvinyl alcohol, and linear polyester. Particularly preferred are nitrocellulose, linear polyester, polyalkyl (meth)acrylate, a mixture of nitrocellulose and linear polyester, and a mixture of nitrocellulose and polyalkyl (meth)acrylate. These binders may be crosslinked with a crosslinking agent.

The phosphor layer can be formed on the support, for instance, by the following procedure.

In the first place, the above-described stimulable phosphor and binder are added to an appropriate solvent, and then they are mixed to prepare a coating dispersion comprising the phosphor particles homogeneously dispersed in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monomethyl ether; and mixtures of the above-mentioned compounds.

The ratio between the binder and the stimulable phosphor in the coating dispersion may be determined according to the characteristics of the aimed radiation image storage panel, the nature of the phosphor employed, etc. Generally, the ratio therebetween is within the range of from 1:1 to 1:100 (binder:phosphor, by weight), preferably from 1:8 to 1:40.

It may be thought that the above-described binder is replaced with a conductive polymer to form a phosphor layer. However, the polymer has poor bonding strength as compared with the above binders, so that the phosphor particles cannot be sufficiently bound with the polymer when the conductive polymer is used alone. When the conductive polymer is used in combination with the binder polymer for enhancing the bonding strength, satisfactory antistatic effect, that is a characteristic requisite of the invention, cannot be obtained. Accordingly, it is difficult to use the conductive polymer as a binder for the phosphor layer in the known ratio between the phosphor and the binder.

The coating dispersion may contain a dispersing agent to improve the dispersibility of the phosphor particles therein, and may contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly onto the surface of the support to form a layer of the coating dispersion. The coating procedure can be carried out by a conventional method such as a method using a doctor blade, a roll coater or a knife coater.

After applying the coating dispersion onto the support, the coating dispersion is then heated slowly to dryness so as to complete the formation of a stimulable phosphor layer. The thickness of the stimulable phosphor layer varies depending upon the characteristics of the aimed radiation image storage panel, the nature of the phosphor, the ratio between the binder and the phosphor, etc. Generally, the thickness of the stimulable phosphor layer is within the range of from 20 μm to 1 mm, and preferably from 50 to 500 μm.

The stimulable phosphor layer can be provided on the support by the methods other than that given in the above. For instance, the phosphor layer is initially prepared on a sheet (false support) such as a glass plate, metal plate or plastic sheet using the aforementioned coating dispersion and then thus prepared phosphor layer is superposed on the support by pressing or using an adhesive agent.

On the surface of the stimulable phosphor layer not facing the support, an electrically conductive polymer layer is provided.

The conductive polymer layer is a layer made of a polymer as such having electric conductivity, and the polymer has a molecular structure in which electrons or positive holes easily move. Accordingly, the structure of the conductive polymer layer is different from that of a layer made of a conventional conductive material such as a layer of a conductive polymer composition (complex material) in which a surfactant or the like is dispersed or an antistatic film as described in the aforementioned U.S. States patent applications and the corresponding EP applications. However, the conductive polymer layer of the panel according to the invention may further contain the above-mentioned conventional conductive materials.

There is no specific limitation on the conductive polymer employable in the invention, provided that the polymer has the above-described function.

Examples of the conductive polymer employable in the invention include conductive acrylic resins (e.g., Corcort NR-121; trade name, available from Corcort Co., Ltd.) and polymers having a siloxane bond (—Si—O—Si—) (e.g., Corcort R; trade name, available from Corcort Co., Ltd.). The polymer having a siloxane bond is coated in the form of a monomer and the monomer is cured in the course of the coating procedure to become a polymer having a three-dimensional network.

The conductive polymer layer can be prepared by the process comprising the steps of dissolving the above-mentioned conductive polymer in an appropriate solvent to prepare a coating solution, applying the coating solution onto the surface of the phosphor layer by the known coating method to give a coated layer of the solution, and drying the coated layer. Thus, a conductive polymer layer can be formed on the stimulable phosphor layer.

The thickness of the conductive polymer layer varies depending upon the position where the polymer layer is to be arranged, the nature of the employed polymer, etc. Generally the thickness thereof is in the range of 0.5 to 20 μm, preferably in the range of 1 to 10 μm. By adjusting the thickness of the conductive polymer layer within the above-specified range, the surface resistance of the polymer layer can be set to not higher than $10^9$ ohm.

On the surface of the conductive polymer layer not facing the phosphor layer, a transparent protective film is provided to protect the resulting panel from physical and chemical deterioration.

The protective film can be provided on the conductive polymer layer by coating the surface of the conductive polymer layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. Alternatively, the transparent film can be provided on the conductive polymer layer by beforehand preparing it from a polymer such as polyethylene terephthalate, polyethylene, polyvinylidene chloride or polyamide, followed by placing and fixing it onto the conductive polymer layer with an appropriate adhesive agent. The transparent protective film preferably has a thickness within the range of approximately 1 to 30 μm.

The above-described process can provide a radiation image storage panel shown in FIG. 1-(1). Panels shown in FIGS. 1-(2) to 1-(5) can be also prepared in the similar manner.

In more detail, a radiation image storage panel of FIG. 1-(2) can be obtained by forming a protective film on the phosphor layer and then providing a conductive polymer layer on the protective film, or initially forming a conductive polymer layer on a transparent thin film (protective film) and combining the transparent thin film and the phosphor layer together.

A radiation image storage panel of FIG. 1-(3) can be obtained by forming a conductive polymer layer on the beforehand prepared phosphor layer and combining thus prepared the composite and the independently prepared support in such a manner that the conductive polymer layer faces the support surface. In the panel shown in FIG. 1-(3), the conductive polymer employed for the preparation of a conductive polymer layer can be incorporated with other additives such as an adhesive agent, a polymer for an undercoating layer, a light-reflecting material and a light-absorbing material to form a conductive polymer layer, whereby the resulting conductive polymer layer also serves as an adhesive layer, an undercoating layer, a light-reflecting layer, and/or a light-absorbing layer.

A radiation image storage panel of FIG. 1-(4) can be obtained by initially forming a conductive polymer layer on one surface of the support and then providing a phosphor layer on other surface of the support.

A radiation image storage panel of FIG. 1-(5) can be obtained by initially forming a back layer on one surface of the support, then forming a conductive polymer layer on the back layer and providing a phosphor layer on the surface of the support not facing the back layer.

In the radiation image storage panel shown in FIG. 1-(4), the same back layer as shown in FIG. 1-(5) may be formed on the conductive polymer layer. The back layer can be obtained by combining a plastic film having a relatively low friction coefficient as a friction reducing layer with the panel using an adhesive agent, as disclosed in Japanese Patent Provisional Publication No. 59(1984)-77400.

It is also possible to provide two or more conductive polymer layers in the radiation image storage panel. For example, the panel of FIG. 1-(1) may be further provided another conductive polymer layer (second conductive polymer layer, which may serve as an undercoating layer), between the support and the phosphor layer. Provision of two or more conductive polymer layers can further enhance the antistatic property of the resulting panel.

The structure of the radiation image storage panel according to the invention is not restricted to the above-mentioned ones, and any other structure such as a structure comprising a support, a phosphor layer and a conductive polymer layer can also be included in the invention.

The radiation image storage panel of the invention may be provided with covering **16*a*, 16*b*** made of a conductive polymer at the edge portion of at least one side of as shown in FIG. 2. The covering is preferably provided on the front end-edge side and on rear end-edge side, the side being based on the transferring direction of the panel. The antistatic effect is much more enhanced by providing the covering on the edge portion of the panel. In more detail, the covering provided on both ends of the panel are brought into smooth contact with the transferring members in the transferring procedure, so that the static charge which is liable to be stored within the panel can be rapidly released to outside of the panel through the smooth contact between the covering and the transferring members. As a result, the panel provided with the conductive polymer layer and the covering can be further improved in the antistatic property.

The radiation image storage panel of the invention may be colored with a colorant to enhance the sharpness of the resulting image, as described in U.S. Pat. No. 4,394,581 and U.S. patent application No. 326,642. For the same purpose, the panel of the invention may contain a white powder in the phosphor layer, as described in U.S. Pat. No. 4,350,893.

As other representative example of the radiation image converting material of the present invention than the above-mentioned radiation image storage panel, there can be mentioned a radiographic intensifying screen as described hereinbefore.

The radiographic intensifying screen according to the invention basically comprises a support and a phosphor layer and is further provided with at least one conductive polymer layer at any desired position.

FIG. 4 shows favorable embodiments of the radiographic intensifying screen of the invention.

Each of FIGS. 4-(1) to 4-(3) is a sectional view illustrating the radiographic intensifying screen comprising a support, a phosphor layer, a protective film and a conductive polymer layer.

In FIG. 4, the screen comprises a support 1, a phosphor layer 2, a protective film 3 and a conductive polymer layer 4. The conductive polymer layer 4 is provided between the phosphor layer and the protective film in FIG. 4-(1), on the surface of the protective film (surface of the screen) in FIG. 4-(2), or between the support and the phosphor layer in FIG. 4-(3).

The above-mentioned structures are given by no means to restrict the structure of the screen of the invention, and any other structure can be applied to the invention. For example, the conductive polymer may be provided on the surface of the support not facing the phosphor layer, or may be provided on one surface of a back layer or the like in the case that such layer is arranged on the support. The screen of the invention may be provided with two or more conductive polymer layers. For example, the screen of FIG. 4-(1) may be further provided with another conductive polymer layer (second polymer layer) between the support and the phosphor layer. Provision of two or more conductive polymer layers can enhance the antistatic properties of the resulting screen.

The radiographic intensifying screen of the invention is described in detail hereinafter referring to the screen shown in FIG. 4-(1).

The radiographic intensifying screen of the invention can be prepared, for instance, by the following process.

The support material employable for the screen can be selected from the same support materials as described in the preparation of the aforementioned radiation image storage panel, and preferred is a plastic film. The plastic film may contain a light-absorbing material such as carbon black or a light-reflecting material such as titanium dioxide.

The radiographic intensifying screen of the invention may have other additional layers such as an adhesive layer, a light-reflecting layer and a light-absorbing layer, as well as in the case of the radiation image storage panel. Further, the screen may be provided with finely protruded and depressed portions on its phosphor layer-side surface for the enhancement of sharpness of an image provided by the screen, as described in Japanese Patent Provisional Publication No. 58(1983)-182599.

Subsequently, on the support is provided a phosphor layer. The phosphor layer comprises a binder and phosphor particles dispersed therein.

A variety of phosphors employable for the intensifying screen have been known, and any one of them can be used in the invention. Examples of the phosphor preferably employable in the invention, which emits light in the ultraviolet to visible region (blue region, green region and red region) include:

- tungstate phosphors such as $CaWO_4$, $MgWO_4$ and $CaWO_4$:Pb;
- terbium activated rare earth oxysulfide phosphors such as $Y_2O_2S$:Tb, $Gd_2O_2S$:Tb, $La_2O_2S$:Tb, $(Y,Gd)_2O_2S$:Tb and $(Y,Gd)_2O_2S$:Tb,Tm;
- terbium activated rare earth phosphate phosphors such as $YPO_4$:Tb, $GdPO_4$:Tb and $LaPO_4$:Tb;
- terbium activated rare earth oxyhalide phosphors such as LaOBr:Tb, LaOBr:Tb,Tm, LaOCl:Tb, LaOCl:Tb,Tm, GdOBr:Tb and GdOCl:Tb;
- thulium activated rare earth oxyhalide phosphors such as LaOBr:Tm and LaOCl:Tm;
- barium sulfate phosphors such as $BaSO_4$:Pb, $BaSO_4$:$Eu^{2+}$ and $(Ba,Sr)SO_4$:$Eu^{2+}$;
- divalent europium activated alkaline earth metal phosphate phosphors such as $Ba_3(PO_4)_2$:$Eu^{2+}$ and $(Ba,Sr)_3(PO_4)_2$:$Eu^{2+}$;
- divalent europium activated alkaline earth metal fluorohalide phosphors such as BaFCl:$Eu^{2+}$, BaFBr:$Eu^{2+}$, BaFCl:$Eu^{2+}$,Tb, BaFBr:$Eu^{2+}$,Tb, $BaF_2.BaCl_2.KCl$:$Eu^{2+}$, $BaF_2.BaCl_2.xBaSO_4.KCl$:$Eu^{2+}$ and $(Ba,Mg)F_2.BaCl_2.KCl$:$Eu^{2+}$;
- iodide phosphors such as CsI:Na, CsI:Tl, NaI:Tl and KI:Tl;
- sulfide phosphors such as ZnS:Ag, (Zn,Cd)S:Ag, (Zn,Cd)S:Cu and (Zn,Cd)S:Cu,Al;
- hafnium phosphate phosphors such as $HfP_2O_7$:Cu;
- europium activated rare earth oxysulfide phosphors such as $Y_2O_2$:Eu, $Gd_2O_2S$:Eu, $La_2O_2S$:Eu and $(Y,Gd)_2O_2S$:Eu;
- europium activated rare earth oxide phosphors such as $Y_2O_3$:Eu, $Gd_2O_3$:Eu, $La_2O_3$:Eu and $(Y,Gd)_2O_3$:Eu;
- europium activated rare earth phosphate phosphors such as $YPO_4$:Eu, $GdPO_4$:Eu and $LaPO_4$:Eu; and
- europium activated rare earth vanadate phosphors such as $YVO_4$:Eu, $GdVO_4$:Eu, $LaVO_4$:Eu and $(Y,Gd)VO_4$:Eu.

The above-described phosphors are given by no means to restrict the phosphor employable in the intensifying screen of the invention. Any other phosphors can be also employed, provided that the phosphor emits light having a wavelength within near ultraviolet to visible region when exposed to a radiation such as X-rays.

As the binder employable for the phosphor layer of the radiographic intensifying screen, there can be mentioned those used in the preparation of the radiation image storage panel.

The phosphor layer can be prepared in the similar manner to that in the preparation of a stimulable phosphor layer of the radiation image storage panel. In more detail, the above-mentioned phosphor and binder are dispersed in an appropriate solvent to prepare a coating dispersion; the coating dispersion is evenly applied onto the support; and the coated layer of the dispersion is dried to form a phosphor layer on the support. The solvent can be selected from those used in the preparation of the stimulable phosphor layer of the radiation image storage panel. The ratio between the binder and the phosphor is generally in the range of 1:1 to 1:100 (binder:phosphor, by weight) and preferably in the range of 1:8 to 1:40. The coating dispersion for the phosphor layer may contain various additives such as a dispersing agent for improving dispersibility of the phosphor particles therein and a plasticizer for enhancing the bonding between the phosphor particles and the binder in the phosphor layer. As the dispersing agent and plasticizer to be incorporated into the coating dispersion, there can be mentioned those described in the preparation of the radiation image storage panel. The coating of the dispersion can be performed by a known coating method such as a method of using a doctor blade, a roll coater and a knife coater, as the in preparation of the radiation image storage panel. The thickness of the phosphor layer is generally in the range of 20 μm to 1 mm, preferably in the range of 50 to 500 μm.

On the surface of the phosphor layer not facing the support is then provided a conductive polymer layer.

A material employable for the conductive polymer layer is a conductive polymer, and the conductive polymer has the same meaning as defined in the case of the radiation image storage panel. Examples of the conductive polymer include the same polymers as used in the preparation of a conductive polymer layer of the radiation image storage panel. The conductive polymer layer can be prepared in the same manner as described in the preparation of the conductive polymer layer of the radiation image storage panel. The thickness of the conductive polymer layer is generally in the range of 0.1 to 20 μm, preferably in the range of 0.5 to 5.0 μm. By adjusting the thickness of the conductive polymer layer in the abovespecified range, the surface resistivity (resistance) of the layer can be set to not higher than $10^9$ ohm. The conductive polymer layer may further contain a known electrically conductive material such as a surfactant.

On the surface of the conductive polymer layer, a transparent film is provided to protect the screen physically and chemically.

The transparent protective film can be formed on the conductive polymer layer using the same material and the same process as described in the preparation of a transparent protective film for the radiation image storage panel. The thickness of the transparent protective film is generally in the range of approx. 1 to 30 μm.

Thus, a radiographic intensifying screen shown in FIG. 4-(1) can be prepared.

A radiographic intensifying screen of FIG. 4-(2) can be obtained by forming a protective film on the phosphor layer and then providing a conductive polymer layer on the protective film, or initially forming a conductive polymer layer on a transparent thin film (protective film) and combining the thin film and the phosphor layer.

A radiographic intensifying screen of FIG. 4-(3) can be obtained by forming a conductive polymer layer on the beforehand prepared phosphor layer and combining the resulting composite material and an independently prepared support in such a manner that the conductive polymer layer faces the support. In this case, the conductive polymer used for the preparation of a conductive polymer layer can be incorporated with other additives such as an adhesive agent, a polymer for an undercoating layer, a light-reflecting material and a light-absorbing material to form a conductive polymer layer, whereby the resulting conductive polymer layer also serves as an adhesive layer, an undercoating layer, a light-reflecting layer or a light-absorbing layer.

The radiographic intensifying screen consisting of a support, a phosphor layer, a transparent protective film and a conductive polymer layer is described above, but the transparent protective film is not always necessary in the invention.

The radiographic intensifying screen of the invention may be provided with a covering made of a conductive material on the edge portion. In this case, the screen can be grounded or electrically connected to an earth by way of the covering. The conductive covering serves as a ground lead (a kind of a ground member) between the conductive polymer layer and a ground conductor (i.e., earth means), and the covering is provided at least one part of the edge portion of the screen.

FIG. 5 is a perspective view illustrating an embodiment of a radiographic intensifying screen obtained by providing a conductive covering at the edge portion of the screen of FIG. 4-(1). FIG. 5-(A) is a sectional view taken along the line I—I of FIG. 5.

As shown in FIGS. 5 and 5-(A), the sides of the edge portion 51 of the screen are provided with several covering **52*a* made of an electrically conductive material (e.g., paste containing metal powder of tin, aluminum and silver) in the form of spots. Further, the back surface (support side surface) of the edge portion 51 of the screen is provided with a covering 52*b* made of an electrically conductive material (e.g., tin, aluminum, silver or a paste containing a powder thereof) in the form of a tape which is in contact with the spot covering 52*a*. In the radiographic intensifying screen of the invention, the spot covering 52*a* and the tape covering 52*b* are generically named herein to a conductive covering 52**. Through the conductive covering, into the conductive polymer layer can be introduced the opposite static charge to the static charge generating on the surface of the screen from the outside of the screen.

In the case of setting the screen in a cassette or a high-speed radiographic apparatus, the cassette or the apparatus may be preferably provided with an earth means 53 made of a silver tape, etc. on the part where the cassette or the apparatus is brought into contact with the conductive covering **52*b*, as shown in FIG. 5**.

The conductive covering can be provided by coating the conductive material onto the conductive polymer layer or combining the material with the conductive polymer layer using an adhesive agent.

In the radiographic intensifying screen of the invention, the conductive covering is required to be provided to be brought into contact with the conductive polymer layer. The conductive covering may be provided in such a manner that the covering covers whole the edge portion of the screen. The conductive covering in the form of a tape may be provided on only the earth and the required position of the cassette or the high-speed radiographic apparatus without providing on the screen.

The following examples further illustrate the present invention, but these examples are understood to by no means restrict the invention.

EXAMPLE 1

To a mixture of a powdery divalent europium activated barium fluorobromide ($BaFBr:0.001Eu^{2+}$) stimulable phosphor and a linear polyester resin were added successively methyl ethyl ketone and nitrocellulose (nitration degree: 11.5%), to prepare a dispersion containing the phosphor and the binder. Subsequently, tricresyl phosphate, n-butanol and methyl ethyl ketone were added to the dispersion. The mixture was sufficiently stirred by means of a propeller agitator to obtain a homogeneous coating dispersion having a mixing ratio of 1:20 (binder:phosphor, by weight) and a viscosity of 25–30 PS (at 25° C.).

The coating dispersion was applied onto a polyethylene terephthalate sheet containing carbon black (support, thickness: 250 μm) placed horizontally on a glass plate. The application of the coating dispersion was carried out using a doctor blade. The support having a layer of the coating dispersion was then placed in an oven and heated at a temperature gradually rising from 25° to 100° C. to dry the coated layer of the dispersion. Thus, a phosphor layer having a thickness of 250 μm was formed on the support.

Independently, to 50 parts by weight of a conductive acrylic resin (trade name: Corcort NR-121, available from Corcort Co., Ltd.) was added methyl ethyl ketone, to prepare a coating solution containing the conductive acrylic resin.

The obtained coating solution was applied onto the phosphor layer and dried in the same manner as described above, to form a conductive polymer layer having a thickness of 2 μm on the phosphor layer.

On the conductive polymer layer was placed a transparent polyethylene terephthalate film (thickness: 10 μm; provided with a polyester adhesive layer on one surface) to combine the transparent film and the conductive polymer layer with the adhesive layer.

Thus, a radiation image storage panel consisting essentially of a support, a phosphor layer, a conductive polymer layer and a transparent protective film, superposed in order, was prepared (see FIG. 1-(1)).

EXAMPLE 2

The procedure of Example 1 was repeated except for providing a transparent protective film on the phosphor layer and then providing a conductive polymer layer on the transparent protective film, to prepare a radiation image storage panel consisting essentially of a support, a phosphor layer, a transparent protective film and a conductive polymer layer, superposed in order (see FIG. 1-(2)).

EXAMPLE 3

The procedure of Example 1 was repeated except for forming a phosphor layer on a transparent polyethylene terephthalate film, then providing a conductive polymer layer on the phosphor layer and combining the polymer layer and an adhesive layer (a polyester adhesive layer, thickness: approx. 10 μm) having been beforehand provided on the support, to prepare a radiation image storage panel consisting essentially of a support, a conductive polymer layer, a phosphor layer and a transparent protective film, superposed in order (see FIG. 1-(3)).

EXAMPLE 4

The procedure of Example 1 was repeated except for forming a conductive polymer layer on one surface of the support and then providing successively a phosphor layer on the surface of the support not facing the polymer layer and a transparent protective film on the phosphor layer, to prepare a radiation image storage panel consisting essentially of a conductive polymer layer, a support, a phosphor layer and a transparent protective film, superposed in order (see FIG. 1-(4)).

EXAMPLE 5

The procedure of Example 1 was repeated except for providing a back layer on one surface of the support by combining an oriented polypropylene film (thickness: 20 μm) and the support through an adhesive layer, then providing a conductive polymer layer on the back layer, and providing successively a phosphor layer on the surface of the support not facing the polymer layer and a transparent protective film on the phosphor layer, to prepare a radiation image storage panel consisting essentially of a conductive polymer layer, a back layer, a support, a phosphor layer and a transparent protective film, superposed in order (see FIG. 1-(5)).

COMPARISON EXAMPLE 1

The procedure of Example 1 was repeated except for not providing a conductive polymer layer, to prepare a radiation image storage panel consisting essentially of a support, a phosphor layer and a transparent protective film, superposed in order.

The radiation image storage panels obtained in Examples 1 to 5 and Comparison Example 1 were evaluated on the transfer property and the occurrence of uneveness of images provided by the panels by the following tests.

Transfer property

Figure 3:
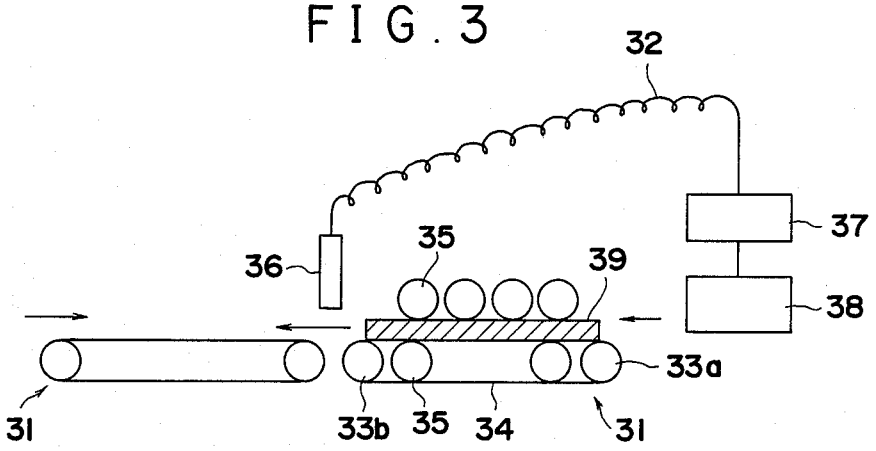
FIG. 3 schematically illustrates a static electricity testing device for evaluating the transfer property of a radiation image storage panel.

The evaluation on the transfer property of the radiation image storage panel was done by using a static electricity testing device shown in FIG. 3.

FIG. 3 is schematically illustrates a static electricity testing device. The device comprises transferring means 31, 31' and an electric potential measuring means (static charge gauge) 32. Each of the transferring means 31, 31' comprises rolls **33*a*, 33*b* made of urethane rubber, an endless belt 34 supported by the rolls and an assisting roll 35 made of phenol resin. The electric potential measuring means 32 comprises a detector 36, a voltage indicator 37 connected to the detector and a recorder 38**.

The evaluation was carried out by introducing the radiation image storage panel into the transferring means 31, 31', subjecting the panel to the repeated transferring procedures of 100 times in the right and left directions (directions indicated by arrows in FIG. 3), then bringing the surface of the panel (protective film-side surface) into contact with the detector 36 to measure the electric potential (KV) on the surface of the panel.

The results are set forth in Table 1.

Occurrence of uneveness of image

A radiation image storage panel having been exposed to X-rays was introduced into the static electricity testing device (placed in a dark room), and the panel was subjected to the repeated transferring procedures of 10 times in the same manner as described above. Then, the panel was subjected to a radiation image recording and reproducing method. The evaluation of the occurrence of uneveness of the resulting image was done by observing occurrence of a noise (i.e., static mark caused by static discharge). This test was conducted in an atmosphere of a temperature of 10° C. and a relative humidity of 20%, and the radiation image recording and reproducing method was carried out using a radiation image reading apparatus (FCR101, produced by Fuji Photo Film Co., Ltd.).

The results are also set forth in Table 1.

TABLE 1

| - | Surface Potential (KV) | Occurrence of Static Mark |
|---|---|---|
| Example 1 | −0.5 | not observed |
| Example 2 | −0.2 | not observed |
| Example 3 | −0.6 | not observed |
| Example 4 | −1.0 | not observed |
| Example 5 | −1.0 | not observed |
| Com. Example 1 | −7.0 | observed (many static marks) |

As is evident from the results set forth in Table 1, each of the radiation image storage panels provided with a conductive polymer layer according to the invention (Examples 1 to 5) had a small potential difference on the surface, and nostatic mark was observed on the image formed by the panels of the invention. Accordingly, the panels of the invention were remarkably improved in the antistatic property. On the other hand, the radiation image storage panel provided with no conductive polymer layer (Comparison Example 1) had a large potential difference on the surface, and a great number of static marks were observed on the image provided by the panel. Thus, the panel for comparison had electricity with a large quantity of static charge.

EXAMPLE 6

To a mixture of a powdery terbium activated gadolinium oxysulfide ($Gd_2O_2S$:Tb) phosphor and 80 parts by weight of a linear polyester resin (trade name: Vylon #500, available from Toyobo Co., Ltd.) were added successively methyl ethyl ketone, 15 parts by weight of nitrocellulose (nitration degree: 11.5%) and 5 parts by weight of isocyanate (trade name: Smidule N-75, available from Sumitomo Bayer Urethane Co., Ltd.). The mixture was sufficiently stirred by means of a propeller agitator to obtain a homogeneous coating dispersion having a mixing ratio of 1:16 (binder:phosphor, by weight) and a viscosity of 25–30 PS (at 25° C.).

The coating dispersion was applied onto a polyethylene terephthalate sheet containing carbon black (support, thickness: 250 μm) placed horizontally on a glass plate. The application of the coating dispersion was carried out using a doctor blade. The support having a layer of the coating dispersion was then placed in an oven and heated at a temperature gradually rising from 25° to 100° C. to dry the coated layer of the dispersion. Thus, a phosphor layer having a thickness of 150 μm was formed on the support.

Independently, to 50 parts by weight of a conductive acrylic resin (trade name: Corcort NR-121, available from Corcort Co., Ltd) was added methyl ethyl ketone, to prepare a coating solution containing the conductive acrylic resin.

The obtained coating solution was applied onto the phosphor layer and dried in the same manner as described above, to form a conductive polymer layer having a thickness of 2 μm on the phosphor layer.

On the conductive polymer layer was placed a transparent polyethylene terephthalate film (thickness: 12 μm; provided with a polyester adhesive layer on one surface) to combine the transparent film and the conductive polymer layer with the adhesive layer.

Thus, a radiographic intensifying screen consisting essentially of a support, a phosphor layer and a transparent protective film, superposed in order, was prepared (see FIG. 4-(1)).

COMPARISON EXAMPLE 2

A commercially available radiographic intensifying screen not provided with a conductive polymer layer (trade name: G-8, available from Fuji Medical Co. Ltd.) was obtained for comparison.

Figure 6:
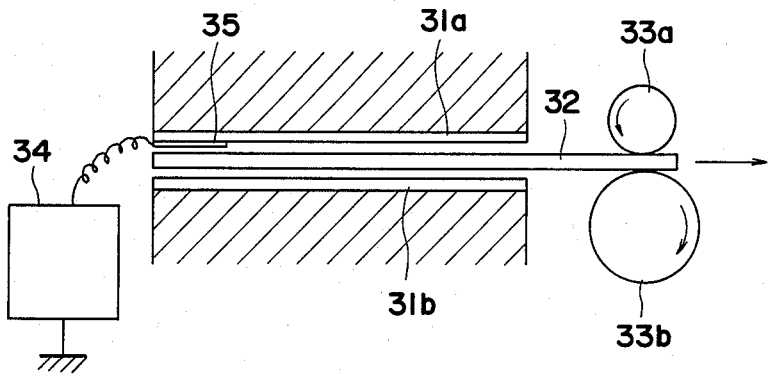
FIG. 6 is a schematic sectional view of a transferring apparatus for testing procedure.

The radiographic intensifying screens of Example 6 and Comparison Example 2 were evaluated on the quantity of electricity (quantity of static charge) on the surface and the antistatic property according to the following tests using a transferring apparatus for testing shown in FIG. 6. The transferring apparatus for testing is a model of a radiographic apparatus for angiocardiography which will be described hereinbelow.

FIG. 6 is a schematic sectional view illustrating the transferring apparatus for testing.

Quantity of electricity on the surface

To a portion of the protective film-side surface of the radiographic intensifying screen was attached a tin foil, to measure the quantity of static charge on the surface of the screen.

In the transferring apparatus for testing shown in FIG. 6, radiographic intensifying screens 61*a* and 61*b*, each provided with a tin foil 65, are fixed in the apparatus in such a manner that those screens face to each other at a certain space, and a radiographic film 62 (trade name: NEW RXO-G, available from Fuji Photo Film Co., Ltd.) is moved into a position between the screens at a constant speed (180 m/min, same speed as that of a commercially available radiographic apparatus for angiocardiography) by means of rollers 63*a*, 63*b*. The tin foil 65 is connected to an electrometer 64 (trade name: TR-8651, produced by Takeda Riken Co., Ltd.).

On the surface of the radiographic film 62 is induced a static charge in proportion to the static charge electrified on the surface of the screen 61*a*. For example, when a negative charge is electrified on the surface of the screen 31*a*, a positive charge is induced on the surface of the film 62. By beforehand insulating the rollers 63*a*, 63*b*, the same quantity of static charge as that of the positive charge is introduced into the film 62 via the tin foil 65 from the electrometer 64 provided on the surface of the screen. On the electrometer 64 is recorded the change of the quantity of electricity with time (i.e., the same quantity and opposite charge to that flowing out from the electrometer, corresponding to the quantity of the static charge on the screen surface).

The results are set forth in Table 2, in which the quantity of electricity is expressed by the maximum value (Q MAX(C)) in the obtained values.

Antistatic Property

The evaluation on the antistatic properties of the screen was done by observing occurrence of noise (static mark) on the radiographic film caused by the static charge induced on the film. The expression "noise on the film" used herein means an exposed portion of the film after the developing procedure followed by the the transferring procedure using the above-mentioned transferring apparatus for testing. The results of the evaluation are classified into the following:

A: no static mark is observed;

B: almost no static mark is observed;

C: some static marks are observed; and

D: a great number of static marks are observed.

The results are also set forth in Table 2.

TABLE 2

| | Quantity of Electricity (Q MAX (C)) | Occurrence of Static Mark |
|---|---|---|
| Example 6 | $0.3 \times 10^{-9}$ | B |
| Com. Example 2 | $2.2 \times 10^{-9}$ | D |

As is evident from the results set forth in Table 2, a radiographic intensifying screen having a conductive polymer layer according to the invention (Example 6) was reduced in the quantity of electricity (static charge) to approx. 1/7 of that in the commercially available radiographic intensifying screen provided with no conductive polymer layer (Comparison Example 2), and further the screen of the invention gave less occurrence of static mark on the radiographic film as compared with the screen for comparison.

EXAMPLE 7

The procedure of Example 6 was repeated except for providing a transparent protective film on the phosphor layer and then providing a conductive polymer layer on the transparent protective film, to prepare a radiographic intensifying screen consisting essentially of a support, a phosphor layer, a transparent protective film and a conductive polymer layer, superposed in order (see FIG. 4-(2)).

EXAMPLE 8

The procedure of Example 6 was repeated except for providing a conductive polymer layer on the support and then providing successively a phosphor layer on the conductive polymer layer and a transparent protective film on the phosphor layer, to prepare a radiographic intensifying screen consisting essentially of a support, a conductive polymer layer, a phosphor layer and a transparent protective film, superposed in order (see FIG. 4-(3)).

Figure 7:
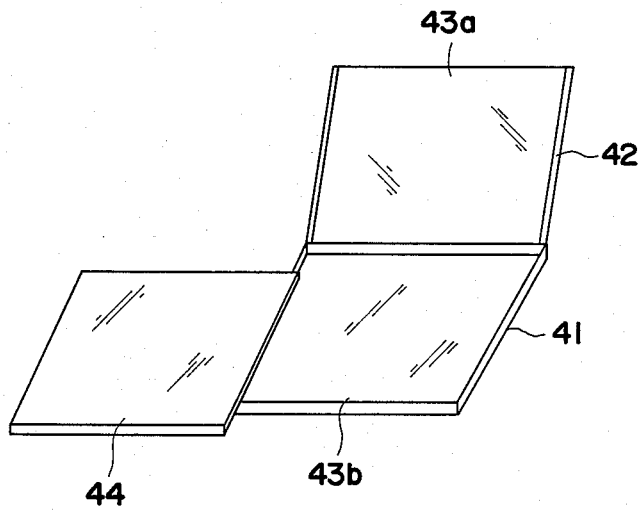
FIG. 7 is a perspective view of a cassette for a radiographic intensifying screen.

The radiographic intensifying screens obtained in Examples 6 to 8 and Comparison Example 2 were evaluated on the electric voltage given on the surface thereof and the antistatic properties according to the following tests using a cassette shown in FIG. 7.

FIG. 7 is a perspective view illustrating a cassette encasing a pair of radiographic intensifying screens and a radiographic film therein.

The cassette comprises a case 71 and a lid 72, and radiographic intensifying screens 73*a*, 73*b* are arranged in the cassette in such a manner that the screen 73*a* is in close contact with the lid 72 (upper portion) and the screen 73*b* is in close contact with the case 71 (lower portion). A radiographic film 74 is encased in the cassette in such a manner that the film is sandwiched between the screen 73*a* and the screen 73*b*.

Electric voltage on the surface of the screen

A pair of radiographic intensifying screens were arranged in the cassette in the same manner as described above, and then a commercially available radiographic film having been subjected to an antistatic treatment was repeatedly moved between the screens at 30 times to rub the surfaces of the film with the surface of each screen. Subsequently, another commercial radiographic film (trade name: NEW RXO-G, available from Fuji Photo Film Co., Ltd.) was stored in the cassette for 5 minutes in such a manner that the film was sandwiched in the screens, and then the film was taken out of the cassette. After the film was taken out of the cassette, the surfaces of both screens were measured on the electric voltage (V). The measurement of the electric voltage was made by means of a voltage indicator (electrostatic voltmeter, produced by Treck Co., Ltd.) in such a manner that the probe of the voltmeter was arranged at a distance of 2.2 mm from the surface of the screen and horizontally to the surface thereof.

The results are set forth in Table 3.

Antistatic property

The evaluation on the antistatic properties of the screen was done by observing occurrence of static mark on the radiographic film after completion of the developing procedure in the same manner as described hereinbefore.

The results are also set forth in Table 3.

TABLE 3

| | Electric Voltage (V) | | Occurrence of |
|---|---|---|---|
| | Upper Screen | Lower Screen | Static Mark |
| Example 6 | −147 | −157 | B |
| Example 7 | 0 | 0 | A |
| Example 8 | −780 | −809 | C |
| Com. Example 2 | −1,000 | −1,000 | D |

As is evident from the results set forth in Table 3, each of the radiographic intensifying screens having a conductive polymer layer according to the invention (Examples 6 to 8) showed an extremely lower voltage than that of the commercial radiographic intensifying screen provided with no conductive polymer layer (Comparison Example 2), and further the screens of the invention gave less occurrence of static mark on the radiographic film as compared with the screen for comparison.

EXAMPLE 9

The procedure of Example 6 was repeated except for providing a conductive covering made of a silver paste and a covering made of a silver tape on the edge portion of the screen, and grounding the screen by way of the tape, to prepare a radiographic intensifying screen consisting essentially of a support, a phosphor layer, a conductive polymer layer and a transparent protective film, superposed in order, and further provided with conductive covering (see FIG. 5-(A)).

COMPARISON EXAMPLE 3

A radiographic intensifying screen obtained by coating an antistatic agent (trade name: Fuji AS Cleaner, available from Fuji Photo Film Co., Ltd.) onto the surface of the protective film of the radiographic intensifying screen in Comparison Example 2 was prepared.

The radiographic intensifying screens prepared in Example 9 and Comparison Example 3 were evaluated on the electric voltage on their surfaces and the antistatic property using the above-mentioned cassette in the same manner as described above.

The results on the evaluations are set forth in Table 4.

TABLE 4

| | Electric Voltage (V) | | Occurrence of |
|---|---|---|---|
| | Upper Screen | Lower Screen | Static Mark |
| Example 9 | −10 | 0 | A |
| Com. Example 3 | −93 | −164 | B |

As is evident from the results set forth in Table 4, the radiographic intensifying screen having a conductive polymer layer and further provided with a conductive covering according to the invention (Example 9) showed an extremely lower voltage than that of the commercially available radiographic intensifying screen coated with an antistatic agent (Comparison Example 3), and further the screen of the invention gave less occurrence of static mark on the radiographic film as compared with the screen for comparison.

The radiographic intensifying screens obtained in Example 6 and 9 were further evaluated on the electric voltage electrified on the surface thereof and the antistatic property according to the following tests using a radiographic apparatus for angiocardiography.

Electric voltage on the surface of the screen

A pair of radiographic intensifying screens were fixed in a radiographic apparatus for angiocardiography (Siemens-AOT, produced by Siemens Co., Ltd.) at a predetermined position, and then a commercially available radiographic film (trade name: NEW RXO-G, available from Fuji Photo Film Co., Ltd.) was moved continuously and automatically between the screens, to measure the electric voltage (V) on the surfaces of both screens (upper screen and lower screen) in the same manner as described before.

The results are set forth in Table 5.

Antistatic property

The evaluation on the antistatic property of the screen was done by observing occurrence of static mark on the radiographic film in the same manner as described above.

The results are also set forth in Table 5.

TABLE 5

| | Electric Voltage (V) | | Occurrence of |
|---|---|---|---|
| | Upper Screen | Lower Screen | Static Mark |
| Example 6 | −28 | −11 | A |
| Example 9 | −270 | +30 | B |

As is evident from the results set forth in Table 5, each of the radiographic intensifying screen having a conductive polymer layer and provided with a conductive covering according to the invention (Example 9) and the radiographic intensifying screen having a conductive polymer layer but not provided with a conductive covering also according to the invention (Example 6) showed an extremely low voltage. Further, occurrence of static mark was never or hardly observed in the radiographic film with respect to the screens of the invention.

We claim:

1. A radiation image converting material comprising a support and a phosphor layer provided on the support which comprises a binder and a phosphor dispersed therein, wherein said support has an electrically conductive polymer layer on the side not facing the phosphor layer, said conductive polymer layer comprising an electrically conductive acrylic resin or a polymer containing a siloxane bond.

2. A radiation image converting material comprising a support, a phosphor layer provided on the support which comprises a binder and a phosphor dispersed therein and a protective layer, wherein said protective layer has an electrically conductive polymer layer on the side not facing the phosphor layer, said conductive polymer layer comprising an electrically conductive acrylic resin or a polymer containing a siloxane bond.

3. The radiation image converting material as claimed in claim 2, wherein said conductive polymer layer has a thickness in the range of 0.5 to 20 μm.

4. A radiation image converting material comprising a support and a phosphor layer provided on the support which comprises a binder and a phosphor dispersed therein and a protective layer, wherein an electrically conductive polymer layer is provided between the protective layer and the phosphor layer or between the support and the phosphor layer, said conductive polymer layer comprising an electrically conductive acrylic resin or a polymer containing a siloxane bond.

5. The radiation image converting material as claimed in claim 4, wherein said conductive polymer layer has a thickness in the range of 0.5 to 20 μm.

6. The radiation image converting material as claimed in claim 1, in which said conductive polymer layer has a thickness in the range of 0.5 to 20 μm.

7. A radiation image converting material comprising a support and a phosphor layer provided on the support which comprises a binder and a phosphor dispersed therein, wherein at least a portion of an edge of said radiation image converting material is covered with electrically conductive polymer layer comprising an electrically conductive acrylic resin or a polymer containing a siloxane bond.

8. The radiation image converting material as claimed in claim 17, wherein said conductive polymer layer has a thickness in the range of 0.5 to 20 μm.

* * * * *